US011408199B2

(12) United States Patent
Gweon et al.

(10) Patent No.: US 11,408,199 B2
(45) Date of Patent: Aug. 9, 2022

(54) VEHICLE KEY ASSEMBLY

(71) Applicants: Hyundai Motor Company, Seoul (KR); Kia Motors Corporation, Seoul (KR); Mobase electronics co., ltd., Suwon-si (KR)

(72) Inventors: Sang Hoon Gweon, Seoul (KR); Nam Ju Lee, Ansan-si (KR); Min Su Ham, Hwaseong-si (KR); Myeong il Jeong, Bucheon-si (KR); Cheol Kim, Ansan-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 351 days.

(21) Appl. No.: 16/800,184

(22) Filed: Feb. 25, 2020

(65) Prior Publication Data

US 2021/0087850 A1 Mar. 25, 2021

(30) Foreign Application Priority Data

Sep. 25, 2019 (KR) ..... 10-2019-0118059

(51) Int. Cl.

| | |
|---|---|
| ***E05B 19/00*** | (2006.01) |
| ***G07C 9/00*** | (2020.01) |
| ***E05B 19/04*** | (2006.01) |
| ***G08C 17/02*** | (2006.01) |

(52) U.S. Cl.

CPC ..... *E05B 19/0082* (2013.01); *G07C 9/00944* (2013.01); *G07C 2009/00952* (2013.01)

(58) Field of Classification Search

CPC ..... Y10T 70/5978; Y10T 70/7876; Y10T 70/8676; Y10T 70/8757; E05B 19/0082; E05B 19/04; G07C 2009/00952

USPC ..... 206/37.1–37.8, 38.1

See application file for complete search history.

(56) References Cited

U.S. PATENT DOCUMENTS

| | | | | |
|---|---|---|---|---|
| 7,690,233 | B2 * | 4/2010 | Katagiri | G07C 9/00944 70/459 |
| 8,479,547 | B2 * | 7/2013 | Kataya | G07C 9/00944 70/252 |
| 8,833,122 | B2 * | 9/2014 | Konchan | E05B 17/0062 206/38.1 |

(Continued)

FOREIGN PATENT DOCUMENTS

| | | | |
|---|---|---|---|
| DE | 102012100162 | A1 * | 7/2013 |
| EP | 1496175 | A1 * | 1/2005 |

*Primary Examiner* — Lloyd A Gall

(74) *Attorney, Agent, or Firm* — Morgan, Lewis & Bockius LLP

(57) ABSTRACT

A vehicle key assembly may include a main body case; an emergency key including a key portion and a knob connected to the key portion and provided to be introduced into the main body case; a restraining member; and a manipulator configured to operate the restraining member, wherein the knob includes: a knob case connected to the key portion and configured to close an opening of the main body case in a state of being accommodated in the main body case; a key ring member mounted on the knob case to be introduced into or retracted from the knob case to be protruded to an outside of the main body case; and one or more elastic members provided in the knob case and configured to press the key ring member in a protrusion direction in which the key ring member is protruded.

13 Claims, 9 Drawing Sheets

(56) References Cited

U.S. PATENT DOCUMENTS

| | | | | |
|---|---|---|---|---|
| 2004/0237613 | A1* | 12/2004 | Shimura | E05B 19/0082 70/456 R |
| 2007/0000295 | A1* | 1/2007 | Donner | G07C 9/00944 70/285 |
| 2007/0214851 | A1* | 9/2007 | Yamaguchi | G07C 9/00944 70/396 |
| 2015/0204108 | A1* | 7/2015 | Ghabra | G07C 9/00944 70/456 R |
| 2020/0318387 | A1* | 10/2020 | Shimura | G07C 9/00944 |

* cited by examiner

VEHICLE KEY ASSEMBLY

CROSS-REFERENCE TO RELATED APPLICATION

The present application claims priority to Korean Patent Application No. 10-2019-0118059, filed on Sep. 25, 2019 in the Korean Intellectual Property Office, the entire contents of which is incorporated herein for all purposes by this reference.

BACKGROUND OF THE INVENTION

Field of the Invention

The present invention relates to a vehicle key assembly which is accommodated with a key ring protruded or not protruded as needed.

Description of Related Art

Recently, vehicles are designed to lock and unlock the doors, start the engine, and open the tailgate using a portable remote control key. To this end, a key assembly includes a main body case, buttons exposed to the outside of the main body case to control various functions, electrical components and batteries provided in the main body case, and an emergency key provided in the main body case and withdrawn from the main body case as needed such that a user manually performs the door opening, the engine starting, the tailgate opening, and the like.

Mostly, the emergency key includes a key portion introduced in the main body case and accommodated therein and a knob coupled to the key portion while being coupled to the main body case with a portion thereof exposed to the outside. The knob may be replaced by a key ring for holding an accessary while provided as a grip. The emergency key is usable when the exposed knob or key ring is gripped by a user and pulled out of the main body case.

However, such a key assembly has a low aesthetic quality and has a difficulty in reducing the volume since the knob or key ring of the emergency key is always exposed to the outside of the main body case. Furthermore, when an external force is inadvertently applied to the exposed knob or key ring, the emergency key may be separated from the main body case.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a vehicle key assembly allowing an emergency key to be accommodated without being protruded to the outside, and as needed, allowing only a key ring member to be protruded or allowing the emergency key to be separated from a main body case.

Various aspects of the present invention are directed to providing a vehicle key assembly allowing a key ring member to be protruded or allowing an emergency key to be separated from a main body case only by operation of manipulating a single manipulator.

Additional aspects of the present invention will be set forth in part in the description which follows, and in part, will be obvious from the description, or may be learned by practice of the present invention.

Therefore, various aspects of the present invention are directed to providing a vehicle key assembly including: a main body case; an emergency key including a key portion and a knob connected to the key portion, and provided to be introduced into the main body case and accommodated therein; a restraining member configured to restrain the emergency key in the main body case or release the restraint of the emergency key; and a manipulator configured to operate the restraining member, wherein the knob includes: a knob case connected to the key portion and configured to close an opening of the main body case in a state of being accommodated in the main body case; a key ring member movably mounted in the knob case to be protruded to an outside of the main body case, in which the key ring member in a state of being introduced into the knob case is restrained by being engaged with the restraining member; and one or more elastic members provided in the knob case and configured to press the key ring member in a protrusion direction in which the key ring member protrudes.

The restraining member may include a first restraining portion selectively engaged to a first locking portion for locking and restraining the first locking portion provided on the key ring member and a second restraining portion for locking and restraining a second locking portion provided on the key portion.

When the restraining member is moved by a first range in a restraint release direction while advancing or retracting in a direction crossing a direction in which the emergency key is withdrawn from the main body case, the restraint of the second locking portion by the second restraining portion may be maintained in a state in which the restraint of the first locking portion by the first restraining portion is released.

When the restraining member is moved by a second range greater than the first range in the restraint release direction thereof, the restraint of the second locking portion by the second restraining portion may be released.

The vehicle key assembly may further include a pressing member mounted inside the main body case and configured to move the restraining member in a restraint direction thereof.

The knob case, accommodated in the main body case, may have an exposed surface maintained at the same level with an end portion of a side of the main body case adjacent to the opening, and the key ring member, introduced into the knob case, may have an exposed surface maintained at the same level with the exposed surface of the knob case.

The key ring member may include a locking step provided on an external surface of the key ring member and configured to limit protrusion of the key ring member by being locked with an internal surface of the knob case.

The elastic member may include a first elastic member and a second elastic member mounted at internal opposite sides of the knob side while being spaced from each other, and configured to apply equal forces to the key ring member.

The vehicle key assembly may further include: a remote controller provided in the main body case and configured to remotely control at least one of an engine starting function, a door opening/closing function, or a tailgate opening/closing function of a vehicle, and one or more function control buttons provided on the main body case to manipulate the remote controller.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
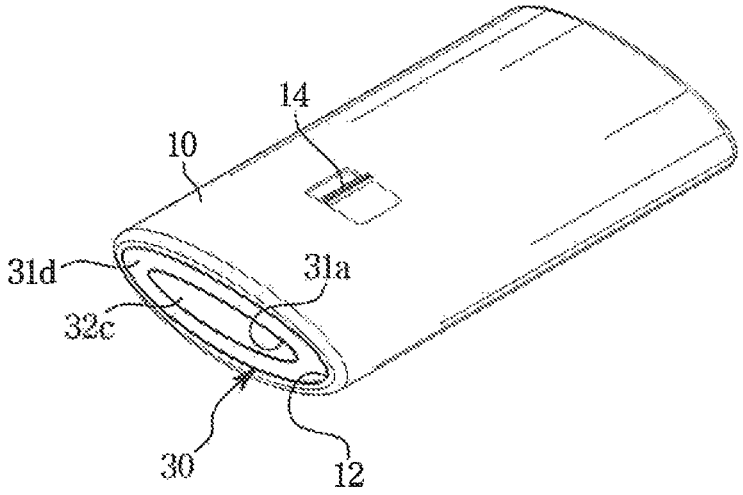
FIG. 1 is a perspective view exemplarily illustrating a vehicle key assembly according to an exemplary embodiment of the present invention, in which an emergency key is accommodated in a main body case.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, embodiments of the present invention will be described in detail with reference to the accompanying drawings. The following embodiments are provided to fully convey the spirit of the present invention to a person having ordinary skill in the art to which an exemplary embodiment of the present invention belongs. The present invention is not limited to the exemplary embodiments shown herein but may be embodied in other forms. To make the description of the present invention clear, unrelated parts are not shown, and the sizes of components are exaggerated for clarity.

Figure 2:
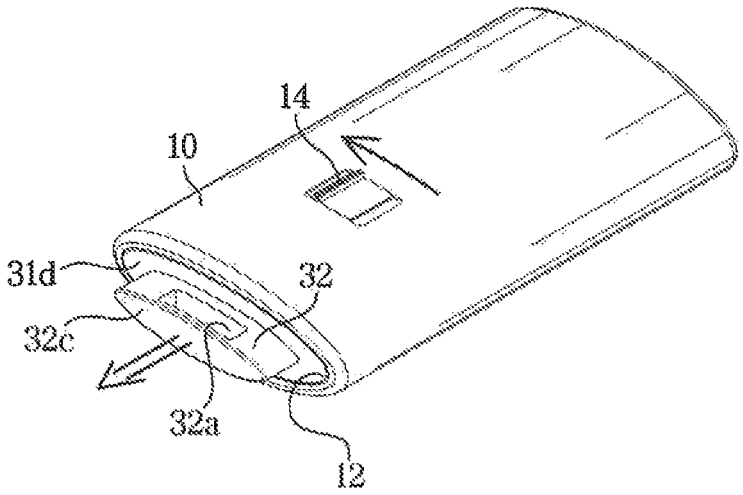
FIG. 2 is a perspective view exemplarily illustrating a vehicle key assembly according to an exemplary embodiment of the present invention, in which a key ring member protrudes.
Figure 3:
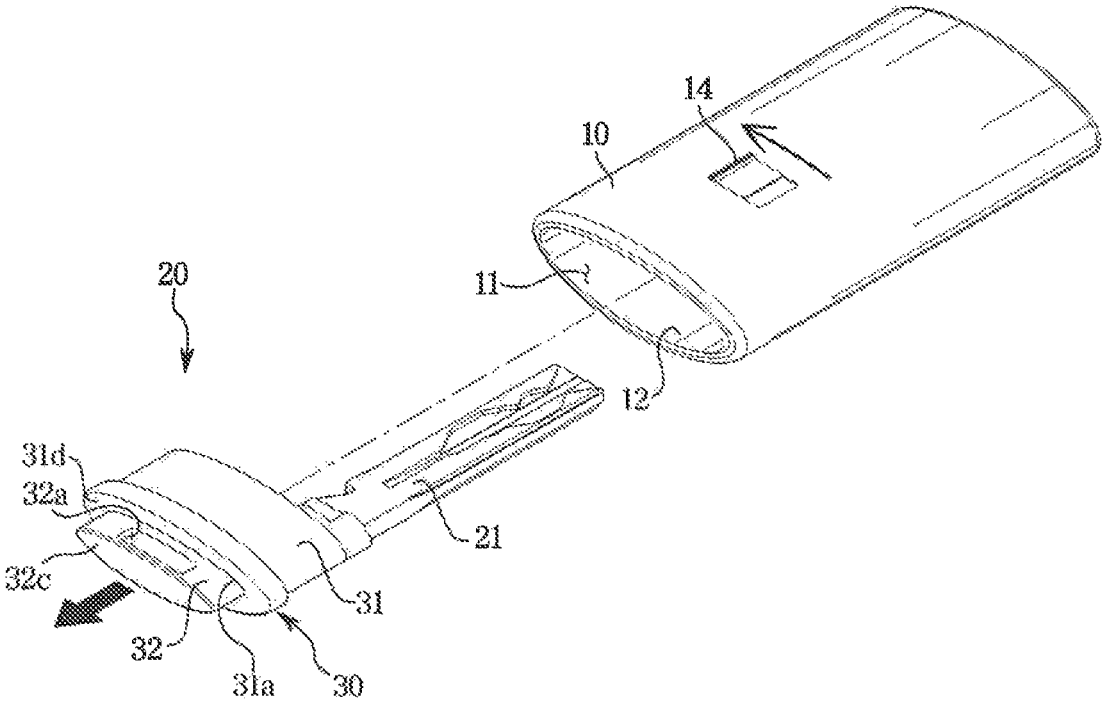
FIG. 3 is a perspective view exemplarily illustrating a vehicle key assembly according to an exemplary embodiment of the present invention, in which an emergency key is separated from a main body case.

FIG. 1 and FIG. 2 are perspective views illustrating a vehicle key assembly according to an exemplary embodiment of the present invention. FIG. 1 shows a state in which an emergency key is accommodated in a main body case, and FIG. 2 shows a state in which a key ring member protrudes, and FIG. 3 shows a state in which the emergency key is separated from the main body case. FIG. 4, FIG. 5, FIG. 6, FIG. 7 and FIG. 8 are cross-sectional views of the vehicle key assembly shown FIG. 1, showing step-wise operations until the emergency key having been accommodated in the main body case is separated the main body case.

Referring to FIG. 1, FIG. 2, FIG. 3, and FIG. 4, a vehicle key assembly according to an exemplary embodiment of the present invention includes a main body case 10, an emergency key 20, and a restraining member 40.

The main body case 10 includes an accommodation space 11 formed therein to accommodate the emergency key 20, and an opening 12 formed at one end portion thereof to allow the emergency key 20 to be introduced into and withdrawn from the main body case 10 therethrough. The emergency key 20 may be accommodated in the accommodation space 11 of the main body case 10 so as not to protrude from the main body case 10 as shown in FIG. 1, FIG. 2, FIG. 3, and FIG. 4.

Referring to FIG. 3, the main body case 10 may have a long side along a direction thereof, in which the emergency key 20 is introduced or withdrawn, with a length longer than the total length of the emergency key 20, and have an elliptical cross section. The remaining side of the main body case 10 except for the opening 12 may be closed. Here, as an example, the main body case 10 is illustrated as having an elliptical cross section, but the shape of the main body case 10 may be variously provided. The main body case may have a polygonal cross section, and may have a width or thickness that varies in the longitudinal direction thereof.

Figure 4:
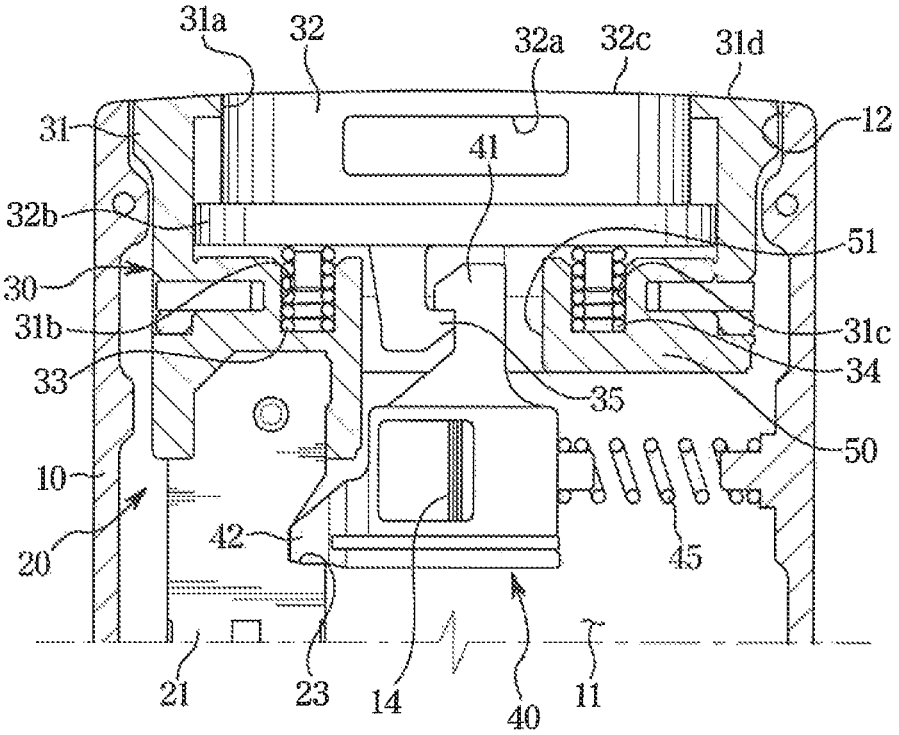
FIG. 4, FIG. 5, FIG. 6, FIG. 7 and FIG. 8 are cross-sectional views of the key assembly shown in FIG. 1, showing step-wise operations until the emergency key having been accommodated in the main body case is separated from the main body case.

Referring to FIG. 4, the restraining member 40 may be mounted in the main body case 10, and configured to restrain the emergency key 20 introduced into the main body case 10 or release the restraint. The restraining member 40 may be operated by a manipulator 14 exposed to the outside of the main body case 10, and may restrain the emergency key 20 to prevent the emergency key 20 from being separated from the main body case 10.

Although the manipulator 14 according to the exemplary embodiment is provided in a form of a switch that is exposed to the outside of the main body case 10, the implementation of the manipulator 14 for operating the restraining member 40 may be variously provided. For example, the manipulator may include an electric actuator and a wireless communication module and may be embedded in the main body case 10 without being exposed to the outside. In the instant case, the manipulator may be controlled from the outside by a wireless communication terminal, such as a smartphone in which an application is installed. That is, the operation of the restraining member 40 may be remotely controlled.

Referring to FIG. 3 and FIG. 4, the emergency key 20 includes a key portion 21 and a knob 30 connected to one end portion of the key portion 21. The key portion 21 represents a key which may be directly manipulated by a user. The user may insert the key portion 21 into a key hole provided in a door, near a steering wheel, or on a tail gate to perform the door opening, the engine starting, the tailgate opening, and the like in a manual method.

The knob 30 is connected to the key portion 21 as shown in FIG. 3 to increase the convenience of operation of the key portion 21. The knob 30 may include a knob case 31, a key ring member 32, and first and second elastic members 33 and 34 as shown in FIG. 4.

One side of the knob case 31 is connected to one end portion of the key portion 21. The knob case 31 has an external appearance corresponding to an internal shape of a side of the main body case 10 adjacent to the opening 12, and is configured to close the opening 12 of the main body case 10 in a state of being introduced into the main body case 10.

The key ring member 32 is movably mounted in the knob case 31. Accordingly, the key ring member 32 may be protruded to the outside of the main body case 10 through an opening 31*a* formed in an exposed surface of the knob case 31 in a state in which the knob case 31 is accommodated in the main body case 10 as needed.

The key ring member 32 has an elliptical cross-sectional structure corresponding to the shape of the opening 31*a* of the knob case 31, and has a hole 32*a* passing through one side and the other side thereof to hold an accessory or the like in a state of being protruded to the outside of the knob case 31

The key ring member 32 may be protruded from the knob case 31 in a direction in which the emergency key 20 is withdrawing from the main body case 10, by a force applied by the first elastic member 33 and the second elastic member 34 mounted in the knob case 31. The key ring member 32 in a state of being introduced into the knob case 31 is restrained by the restraining member 40, and thus is prevented from being protruded from the knob case 10.

The first elastic member 33 and the second elastic member 34 are mounted on the internal opposite sides of the knob case 31 while being spaced from each other, and are configured apply the equal forces to the key ring member 32 such that the key ring member 32 is easily protruded to the outside of the knob case 31. The first and second elastic members 33 and 34 may be provided as compression coil springs, and in a state of being accommodated in spring grooves 31*b* and 31*c* formed at opposite sides of the knob case 31, may apply a force to the key ring member 32 in a direction in which the emergency key 20 protrudes. In an exemplary embodiment of the present invention, the first and second elastic members 33 and 34 are mounted to apply equal forces to the opposite sides of the key ring member 32, but the elastic member that allows the key ring member 32 to be protruded may include one or more elastic members.

The key ring member 32 is provided with a locking step 32*b* formed along an external circumference thereof to be locked with an internal surface of a side of the knob case 31 adjacent to the opening 31*a*, to limit the protrusion range of the key ring member 32 being protruded by the pressing of the first and second elastic members 33 and 34.

Referring to FIGS. 1 and 4, the knob case 31, accommodated in the main body case 10, may have an exposed surface 31*d* maintained at the same level with an end portion of aside of the main body case 10 adjacent to the opening 12. Also, the key ring member 32, introduced into the knob case 31, may have an exposed surface 32*c* maintained at the same level with the exposed surface 31*d* of the knob case 31. Accordingly, the key assembly may secure aesthetic quality in a state in which the emergency key 20 is accommodated in the main body case 10 as shown FIG. 1, FIG. 2, FIG. 3, and FIG. 4, having no protruding portion, so that the emergency key 20 is prevented from being unintentionally separated from the main body case 10.

The restraining member 40 may include a first restraining portion 41 for locking and restraining a first locking portion 35 provided on the key ring member 32 and a second restraining portion 42 for locking and restraining a second locking portion 23 provided on a side surface of the key portion 21.

The restraining member 40 may be slidably supported in the main body case 10 to advance or retract in a direction crossing a direction in which the emergency key 20 is withdrawn from the main body case 10, and may be connected to the manipulator 14 exposed to the outside of the main body case 10. Accordingly, when the user manipulates the manipulator 14 to operate the restraining member 40 in the direction crossing the direction in which the emergency key 20 is withdrawn, the first restraining portion 41 releases the restraint of the first locking portion 35, and the second restraining portion 42 may release the restraint of the second locking portion 23.

In an exemplary embodiment of the present invention, the knob case 31 may include a base 50 and an opening 51 on the base 50 such that the first restraining portion 41 may be engaged to the first locking portion through the opening 51.

Referring to FIG. 4, the restraining member 40 is pressed by a pressing member 45 mounted in the main body case 10, so that the first restraining portion 41 and the second restraining portion 42 move in a restraint direction thereof, restraining the key portion 21 and the key ring member 32 of the emergency key 20. The pressing member 45 may be provided as a normal compression coil spring, and with one side supported on the internal surface of the main body case 10, may press and move the restraining member 40 in the restraint direction (a direction crossing the direction in which the emergency key is withdrawn).

Figure 5:
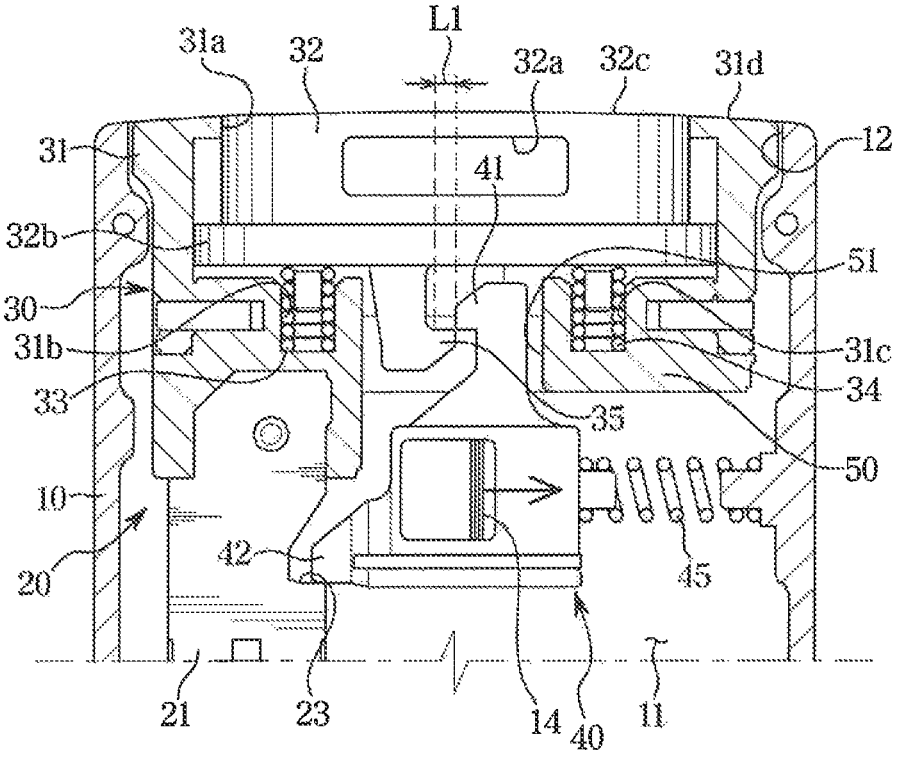
Figure 6:
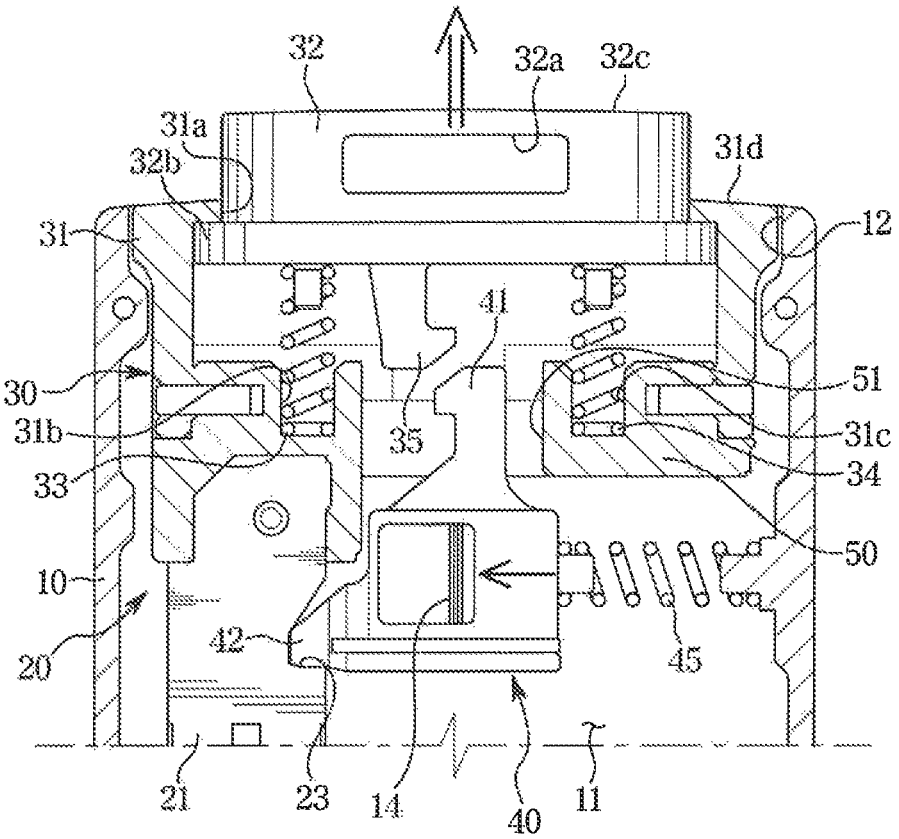

Referring to FIG. 5 and FIG. 6, when the restraining member 40 is moved from a restrained position by a first range L1 in a restraint release direction by the manipulation of the manipulator 14, the restraint of the first locking portion 35 by the first restraining portion 41 may be released, and in the instant state, the restraint of the second locking portion 23 by the second restraining portion 42 may be maintained. This is because when the restraining member 40 is moved only by the first range L in the restraint release direction thereof, the locking of the first locking portion 35 by the first restraining portion 41 is released but the locking of the second locking portion 23 by the second restraining portion 42 is maintained. Accordingly, in the instant case, as shown in FIG. 6, the key ring member 32 protrudes out of the knob case 31 by the extension of the first and second elastic members 33 and 34, and the restraint of the key portion 21 and the knob case 31 in the main body case 10 is maintained. As shown in FIGS. 2 and 6, the user may use the vehicle key assembly by allowing only the key ring member 32 to be protruded for holding an accessory thereon.

Figure 7:
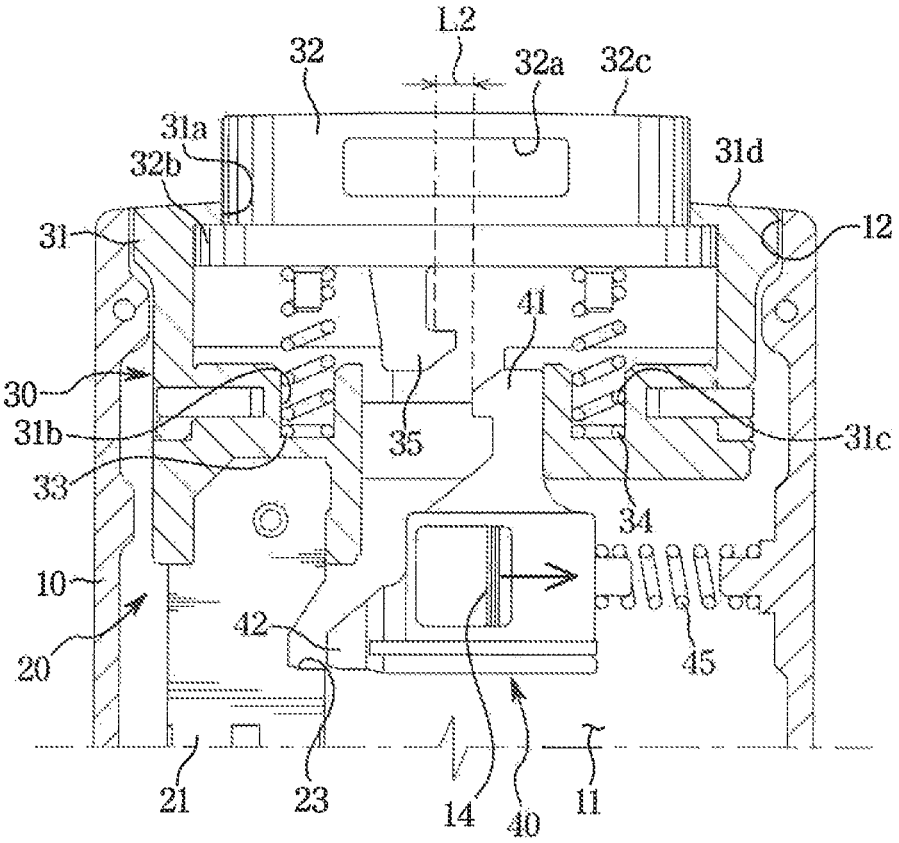
Figure 8:
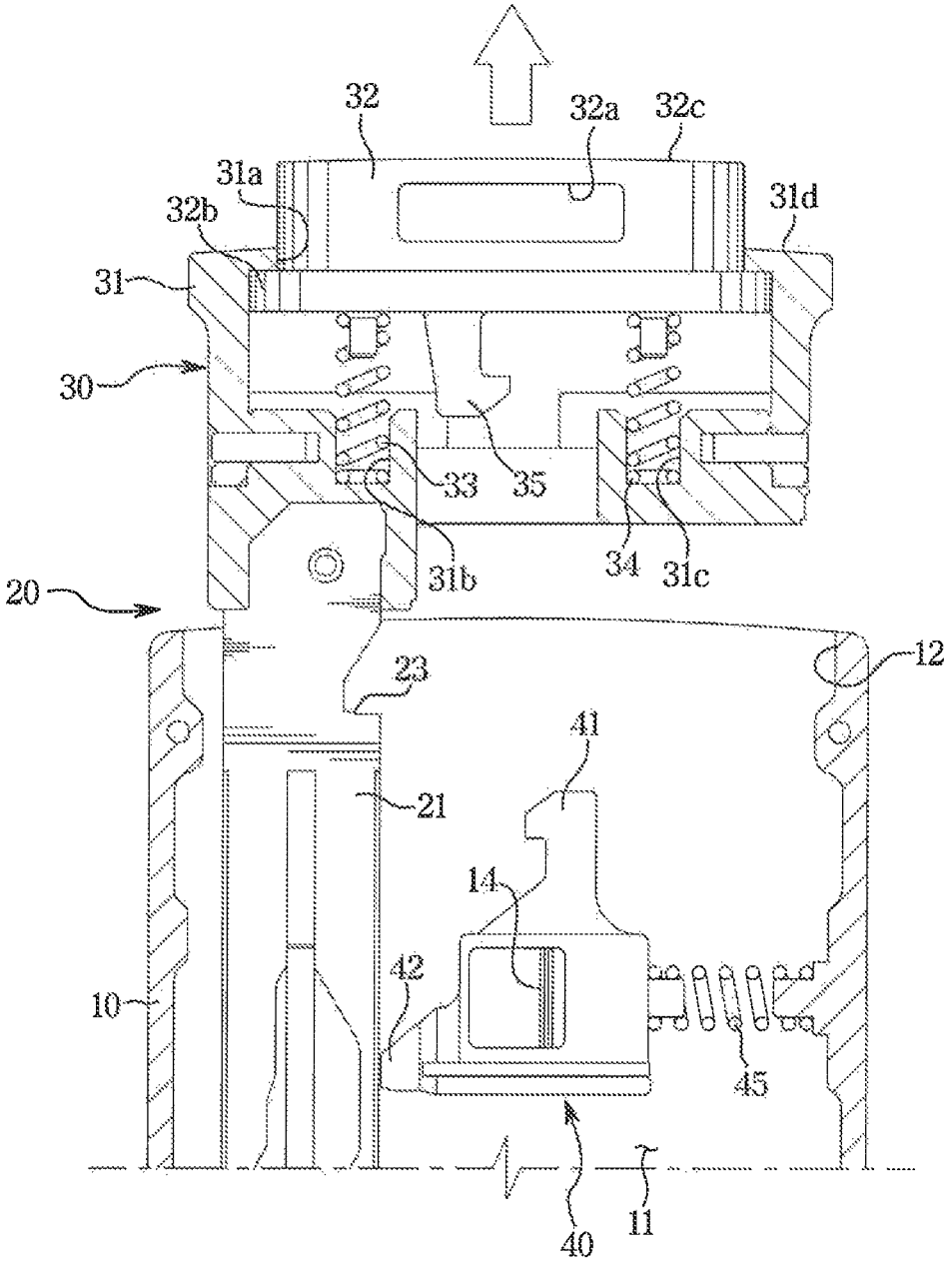

In a state shown in FIG. 6, when the restraining member 40 is moved by a second range L2 greater than the first range L1 in the restraint release direction thereof, the second restraining portion 42 is separated from the second locking portion 23, so that the restraint of the second locking portion 23 may be released as shown in FIG. 7. Accordingly, in a state shown in FIG. 7, when the user grips the key ring member 32 protruded to the outside and then pulls the key ring member 32 outward as shown in FIG. 8, the emergency key 20 is easily separated from the main body case 10.

As described above, the vehicle key assembly according to the exemplary embodiment may allow the key ring member 32 to be protruded or allow the emergency key 20 to be separated from the main body case 10 by only the operation of manipulating the manipulator 14 in a step-wise manner to move the restraining member 40 by the first range L1 or the second range L2.

Figure 9:
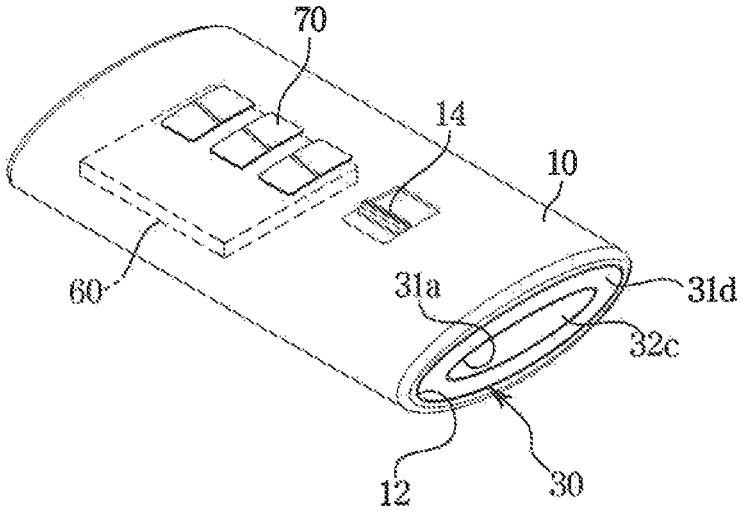
FIG. 9 is a view exemplarily illustrating a vehicle key assembly according to various exemplary embodiments of the present invention.

FIG. 9 is a view exemplarily illustrating a vehicle key assembly according to various exemplary embodiments of the present invention. The vehicle key assembly includes a remote controller 60 provided in a main body case 10 and one or more function control buttons 70 provided to be exposed out of the main body case 10 to manipulate the remote controller 60.

The remote controller 60 may remotely control at least one of an engine starting function, a door opening/closing function, and a tailgate opening/closing function of the vehicle. The remote controller 60 may include a communicator for communicating with a controller of the vehicle and a battery for supplying power to the remote controller 60.

The vehicle key assembly may open or close the door or tailgate of the vehicle, and may control the starting and stopping of the engine by manipulation of the function control buttons 70. Furthermore, the vehicle key assembly may allow the horn to be blown or control the operation of various devices mounted in the vehicle.

As is apparent from the above, the vehicle key assembly can allow the key ring member to be protruded or allow the emergency key to be separated from the main body case only by operation of manipulating a single manipulator to move a restraining member by a first range or a second range.

The vehicle key assembly can provide aesthetic quality by allowing the emergency key to be accommodated in the main body case without being protruded. Since no portion of the emergency key is exposed, the emergency key may be prevented from being unintentionally separated from the main body case.

The vehicle key assembly can allow only the key ring member to be protruded as needed such that the key ring member is used for holding accessories and the like.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A vehicle key assembly comprising:

a main body case;

an emergency key including a key portion and a knob connected to the key portion, and provided to be selectively introduced into a first opening of the main body case and accommodated therein;

a restraining member configured to selectively restrain the emergency key in the main body case; and a manipulator connected to the restraining member and configured to operate the restraining member, wherein the knob includes:

a knob case connected to the key portion and slidably accommodated in the main body case to close the first opening of the main body case while the knob case is accommodated in the main body case;

a key ring member movably mounted in the knob case to be protruded to an outside of the main body case through the first opening of the main body case, wherein the key ring member is configured to be restrained by being engaged with the restraining member in a state of being introduced into the knob case; and at least one elastic member mounted between the knob case and the key ring member and configured to elastically press the key ring member in a first predetermined direction in which the key ring member is protruded outside the knob case.

2. The vehicle key assembly of claim 1, wherein the restraining member includes:

a first restraining portion selectively engaged to a first locking portion formed on the key ring member for locking and restraining the first locking portion; and a second restraining portion selectively engaged to a second locking portion formed on the key portion for locking and restraining the second locking portion.

3. The vehicle key assembly of claim 2, wherein the first restraining portion is aligned to be vertical to the second restraining portion.

4. The vehicle key assembly of claim 2, wherein the knob case includes a base and a second opening on the base and the first restraining portion is selectively engaged to the first locking portion through the second opening.

5. The vehicle key assembly of claim 2, wherein when the restraining member is moved by a first range in a restraint release direction while advancing or retracting in a direction crossing a direction in which the emergency key is withdrawn from the main body case, a restraint of the second locking portion by the second restraining portion is maintained in a state in which a restraint of the first locking portion by the first restraining portion is released.

6. The vehicle key assembly of claim 5, wherein when the restraining member is moved by a second range greater than the first range in the restraint release direction, the restraint of the second locking portion by the second restraining portion is released.

7. The vehicle key assembly of claim 5, further including:

a pressing member mounted inside the main body case and configured to move the restraining member in a second predetermined direction for the restraining member to be engaged to at least one of the first locking portion and the second locking portion.

8. The vehicle key assembly of claim 7, wherein the pressing member is aligned in a radial direction of the main body case.

9. The vehicle key assembly of claim 1, wherein the knob case, accommodated in the main body case, has an exposed surface maintained at a same level with an end portion of a side of the main body case adjacent to the first opening, and wherein the key ring member, introduced into the knob case, has an exposed surface maintained at a same level with an exposed surface of the knob case.

10. The vehicle key assembly of claim 1, wherein the key ring member includes a locking step provided on an external surface of the key ring member and configured to limit protruding of the key ring member by being locked with an internal surface of the knob case.

11. The vehicle key assembly of claim 1, wherein the at least one elastic member includes a first elastic member and a second elastic member mounted at a first side and a second side in the knob case and spaced from each other, and configured to apply equal forces to the key ring member.

12. The vehicle key assembly of claim 11, wherein the knob case includes a base and a second opening on the base, and wherein the first elastic member and the second elastic member are mounted at the first side and the second side around the second opening of the knob case.

13. The vehicle key assembly of claim 1, further including:

a remote controller provided in the main body case and configured to remotely control at least one of an engine starting, opening or closing of a door, or opening or closing of a tailgate of a vehicle, and at least a control button mounted on the main body case to manipulate the remote controller.

* * * * *